United States Patent [19]

Erickson et al.

[11] 4,248,130

[45] Feb. 3, 1981

[54] KEYBOARD ASSEMBLY

[75] Inventors: Norman Erickson; James Meier, both of Des Plaines, Ill.

[73] Assignee: Norlin Industries, Inc., Lincolnwood, Ill.

[21] Appl. No.: 936,360

[22] Filed: Aug. 24, 1978

Related U.S. Application Data

[63] Continuation-in-part of Ser. No. 699,946, Jun. 25, 1976, Pat. No. 4,128,035.

[51] Int. Cl.[3] ..... G10C 3/12

[52] U.S. Cl. ..... 84/434; 84/436; 84/439

[58] Field of Search ..... 84/433, 434, 435, 436, 84/423, 439

[56] References Cited

U.S. PATENT DOCUMENTS

| | | | |
|---|---|---|---|
| 3,087,368 | 4/1963 | Lund | 84/423 R |
| 3,120,146 | 2/1964 | Stiles | 84/433 |
| 3,447,414 | 6/1969 | Lo Duca | 84/436 |
| 3,561,315 | 2/1971 | Ohno | 84/433 |
| 3,663,738 | 5/1972 | Nakada | 84/423 R |
| 3,722,351 | 3/1973 | Allen et al. | 84/423 R |
| 3,835,235 | 9/1974 | Amano | 84/433 |
| 3,855,894 | 12/1974 | Thomas et al. | 84/423 |

*Primary Examiner*—Gene Z. Rubinson
*Assistant Examiner*—Shelley Wade
*Attorney, Agent, or Firm*—Hill, Van Santen, Steadman, Chiara & Simpson

[57] ABSTRACT

A keyboard assembly incorporates a plurality of key members molded of thermoplastic material, each of the keys having an integrally formed pivot wall supported on a pair of pivot points disposed on a pair of pivot members integral with a pivot bracket. A key guide strip for the key member has a pair of vertically aligned projections, for supporting bumpers which guide the forward end of the key member and which provide a cushioning action for noiselessly stopping of upward movement of the key member.

6 Claims, 9 Drawing Figures

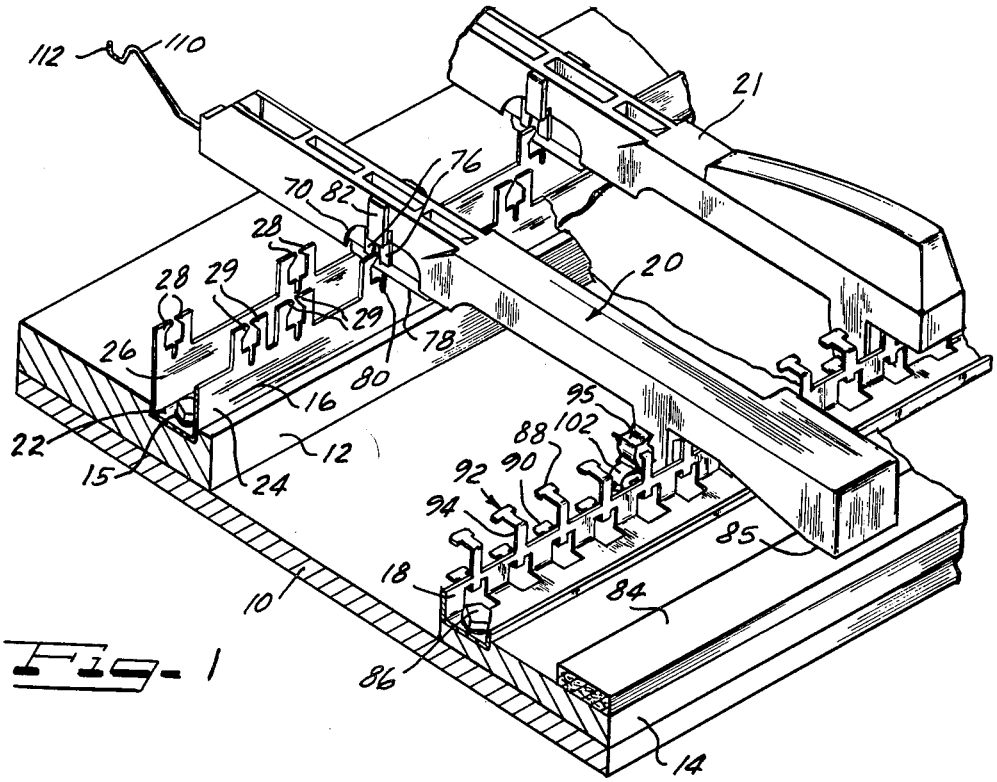
Fig. 1
Fig. 5
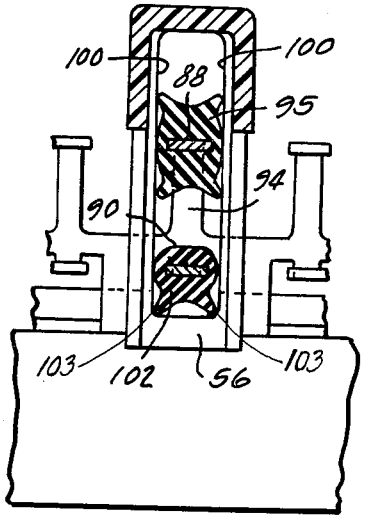
Fig. 6
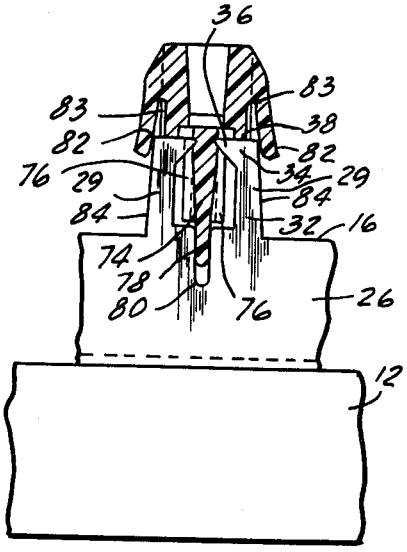

KEYBOARD ASSEMBLY

BACKGROUND

This is a continuation-in-part of copending application of Erickson et al Ser. No. 699,946, filed June 25, 1976, now U.S. Pat. No. 4,128,035.

FIELD OF THE INVENTION

The present invention relates to a keyboard assembly for a keyboard musical instrument, and more particularly to such an instrument in which one or more electrical key switches are closed in response to manual depression of a key.

THE PRIOR ART

A variety of different types of keyboard assemblies have been devised in the prior art. In many of them, a large number of components must be connected together, including several components for each key member, and then the key members and other components must be manually adjusted and aligned to allow all of the keys to operate in the proper manner, and to locate each key properly relative to a fulcrum about which it rotates, with the result that the assembly of the keyboard assembly is relatively complicated and expensive. Typically, in previously known apparatus, a single member performs the several functions of guiding the up and down movements of the key members, and resiliently stopping the key in one or both of its two operated and unoperated positions. It has been found, however, that the preferred characteristic for materials which adequately guide movement of the keys is not the most desirable for limiting key movement. Accordingly, it is desirable to provide a simple and inexpensive keyboard structure which can achieve optimum characteristics for both functions. It is accordingly, therefore, desirable to produce a keyboard assembly in which each key is positively located in the proper position by simple manual positioning. It is also desirable to provide simple and effective means for aligning properly the fronts of the keys, which are manipulated by a player, and for providing optimum limiting of movement of the keys during operation and during release. It is also desirable to provide a keyboard assembly in which individual adjustments of the various keys are not required.

BRIEF DESCRIPTION OF THE INVENTION

It is a principal object of the present invention to provide a keyboard assembly by which assembly of the keyboard structure may be facilitated, with means for automatically locating the keys at their proper positions.

Another object of the present invention is to provide a keyboard assembly including novel means for restraining undesired movements of the keys.

A further object of the present invention is to provide novel means to cushion the stopping of the key in its up and down positions.

These and other objects and advantages of the present invention will become manifest by an inspection of the following description and the accompanying drawings.

In one embodiment of the present invention, there is provided a keyboard assembly having rotatable elongate key members, the key members having spaced vertical side walls, a bracket member for supporting upper and lower vertically aligned projections between the side walls of each key member, a resilient member mounted on each upper projection for guiding the key members and a resilient member mounted on each lower projection for limiting movement of the key members.

BRIEF DESCRIPTION OF THE DRAWINGS

Reference will now be made to the accompanying drawings in which:

FIG. 1 is a perspective view of a portion of a keyboard assembly incorporating an illustrative embodiment of the present invention;

FIG. 5 is a vertical cross section of a part of the key illustrated in FIG. 3 taken in the section V—V;

FIG. 6 is a vertical cross section of a portion of the key illustrated in FIG. 3 taken in the section VI—VI.

Figures 2, 3, 4:
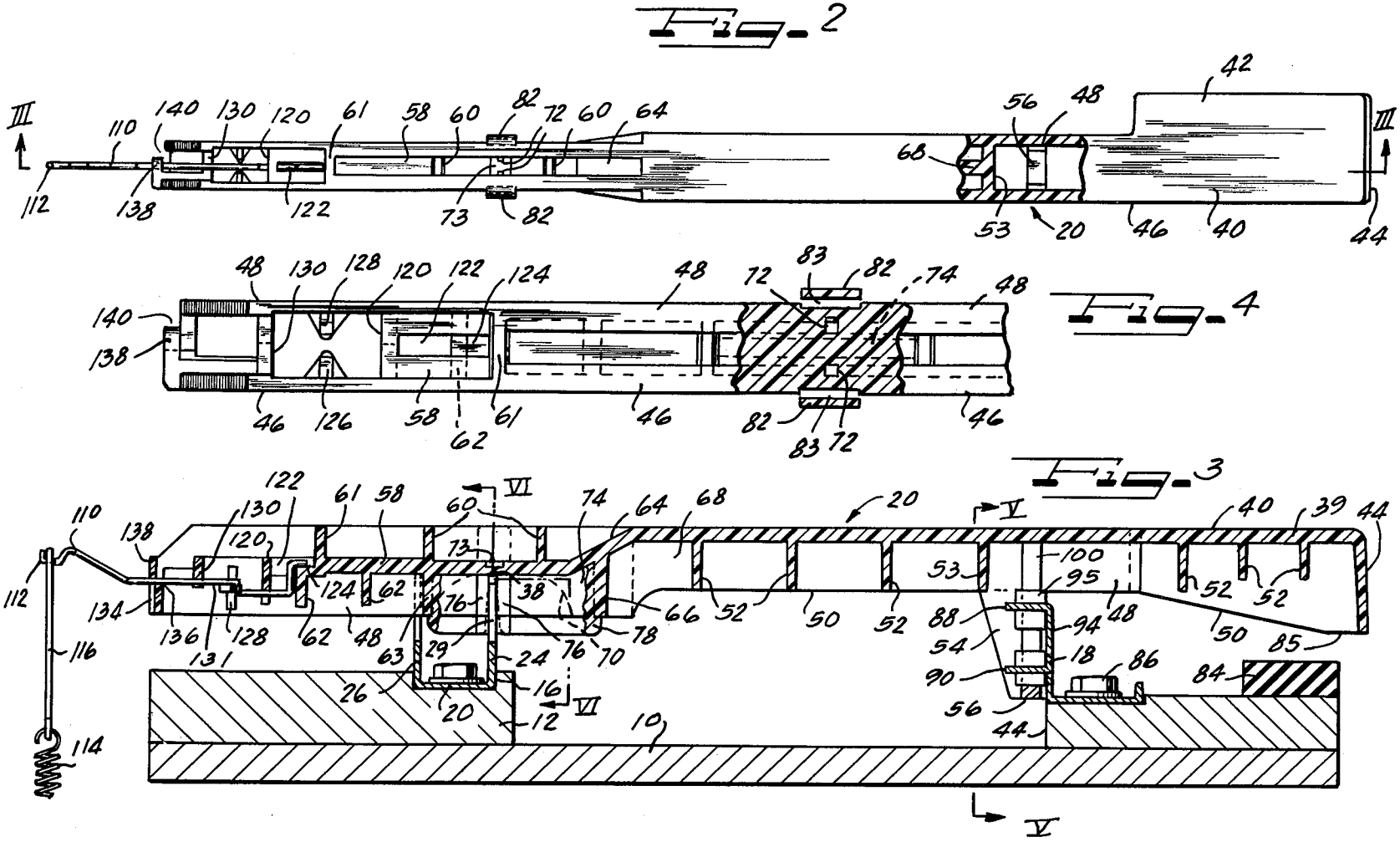
FIG. 2 is a plan view of a key employed in the assembly illustrated in FIG. 1.
FIG. 3 is a vertical cross sectional view of the key of FIG. 2 taken through the plane III—III.
FIG. 4 is an enlarged view of a portion of the key of FIG. 2, partly in cross section.

Referring first to FIG. 1, a perspective view of a keyboard assembly is illustrated, with only two keys being shown for the purpose of clarity. A base plate 10 has secured thereto a pivot channel support member 12 and a guide strip support member 14. A pivot channel 16 is secured by means of screws 15 or the like to the support member 12, and a bracket or guide strip 18 is secured in a similar fashion to the support member 14. The pivot channel 16 and the guide strip or bracket 18 are supported in aligned relation, so that they cause the key members to be aligned, as will now be described.

A key member 20 is mounted in relation to the pivot channel 16 and the guide strip 18 so as to be maintained in proper position relative to other keys of the keyboard. A second key 21 is also so mounted. The key 20 is a "white" (natural) key and the key 21 is a "black" (sharp) key. As shown in FIG. 1, the key members 20 and 21 are both illustrated in position just before assembly. After assembly, the key members are somewhat lower relative to the pivot channel 16. After assembly, the key members are also positively located in a longitudinal direction by means described hereinafter. The key member 20 may pivot about a horizontal axis defined by pointed end portions of pivot members 29 which extend upwardly from the pivot channel 16, and the key member 21 is pivotally mounted in relation to pivot members 28. The forward portion of both key members are guided in up and down movement, by resilient guide bumpers mounted on the guide strip 18.

The pivot channel 16 is a U-shaped member having a bottom wall 22 and forward and rear upstanding side walls 24 and 26, respectively. The side walls 24 and 26 are preferably formed integrally with the bottom wall 22, so that the entire pivot channel 16 forms a rigid assembly when it is secured to the support member 12. A plurality of opposing pairs of upstanding projections or pivot members 28 extend upwardly from the rear wall 26 of the bracket 16, and a plurality of identical pairs of pivot members 29 project upwardly from the forward wall 24 of the bracket 16. The pivot members 28 and 29 are adapted to serve the function of a fulcrum for the various keys of the keyboard, the pivot members 29 for the white keys and the pivot members 28 for the black ones.

An elevation of the rear wall 26 of the pivot channel 16 is illustrated in FIG. 6. The pivot members 28 are provided in cooperating pairs, in which the two projections of each pair are mirror images of each other. Each pivot member has a stem portion 32 which extends upwardly from the upper surface of the wall 26, and a terminal portion 34. The extreme inner end 36 of the terminal portion 34 is pointed, i.e., rounded with a small radius. The pointed inner ends serve as pivot points for the key member 20. Since the inner ends 36 are the only parts which touch the key member, the specific shape of the terminal portion 34 is not critical, and other shapes may be substituted, as long as there is a pivot point for engaging the key member. The upper edges 38 of the terminal portions 34 function as stop members, for locating the key members in proper position during assembly.

A vertical cross sectional view of the key member 20 is illustrated in FIG. 3. It is preferably molded in one integral piece of material, which is preferably a thermoplastic resin. The forward end of the key member 20 has an upper wall 39 with a playing surface 40 which is adapted to be engaged by a finger of an operator or player of the instrument. The wall 39 is shaped in conventional fashion, and since the key member 20 is a white key, its forward end has an offset 42, which accommodates an adjacent black key, in conventional fashion.

An end wall 44 is joined with the forward edge of the wall 39, and side walls 46 and 48 have their forward edges joined with the side edges of the end wall 44 and their upper edges joined with the side edges of the wall 39. The lower edges 50 of the walls 46 and 48 are generally horizontal. A plurality of transverse ribs 52 and 53 extend downwardly from the lower surface of the wall 39, and perform a stiffening function to make the key member 20 relatively rigid. In addition, the ribs 52 separate and break up the volume enclosed by the hollow key member 20 into a series of relatively small volumes instead of one large volume, with the result that there is relatively little resonant reverberation resulting from the touching of the playing surface 40 by the finger of an operator or player.

At a point just behind the offset 42, a projection 54 extends downwardly from each of the side walls 46 and 48, and is preferably formed integrally therewith. The bottom of each projection 54 of the two side walls is joined with a web 56, the purpose and function of which is described hereinafter.

The rear portion of the key member 20 includes a horizontal member 58, which is a flat horizontal wall section having its two side edges joined at approximately the middle of the side walls 46 and 48. A plurality of ribs 60 and 61 extend upwardly from the member 58, between the side walls 46 and 48, and ribs 62 and 63 extend downwardly from the member 58, also between the side walls 46 and 48.

The member 58 is joined with the wall 39 by means of an inclined member 64. A rib 66 depends from the lower surface of the member 64, between the side walls 46 and 48 of the key. A medial wall 68 is secured to the central portion of the forward side of the wall 66 and extends forwardly to the rear surface of the wall 53, performing a stiffening function. The ribs 52 extend between the medial wall 68 and the side walls 46 and 48.

The structure of the key member 20, as thus far described, comprises an extremely rigid assembly, which is nevertheless relatively light in weight and inexpensive to manufacture, since relatively little material is required. It is a construction which is adapted to be produced as an integral unit by conventional injection molding techniques. The bottom edges 50 of the side walls 46 and 48 are each raised, behind the wall 66 to the same level as the member 58 at a position directly over the pivot members 29. The bottom edges 50 of the side walls 46 and 48 are located near the upper edges 38 of the pivot members 29, for the upper edges serve as stop members, when the key member 20 is assembled with the pivot members, as described hereinafter. The key member 20 is adapted to pivot about the pointed end portions 36 of the pivot members 29. Two apertures 72 are provided in the member 58, directly above the pivot members 29. The apertures 72 extend to a recess 73 provided in the top surface of the member 58. The recess 73 and the apertures 72 facilitate the lubrication of the pivot members 29, if necessary, from a location above the key 20.

Immediately to the rear of the wall 66, a longitudinal pivot wall 74 is located, disposed midway between the side walls 46 and 48, and having its upper edge joined with the lower surface of the members 58 and 64. Its rear end is joined with the forward surface of the rib 63. The pivot wall 74 is adapted to be received in the gap between the pivot points 36 of a pair of the pivot members 29, so that the key is located in fixed lateral position. The lower part of the pivot wall is wedge-shaped, to assist in inserting the pivot wall into position. A pair of locating ridges 76 are formed integrally with the pivot wall 74, and receive the pivot points 36 of the pivot members 29 therebetween. The ridges 76 serve to locate the position of the key longitudinally. Because of the triangular or pointed shape of the terminal portions 34, the ribs do not restrict rotation of the key 20. The ridges 76 are each inclined, relative to the vertical, to receive pivot points which are initially somewhat out of position relative to the key member 20, and to locate the key properly when it is assembled by inserting the pivot wall 74 into place. Since the ridges 76 are located on both sides of the pivot wal 74, the pivot members 29 are positively located on both sides of the pivot wall 74. The pivot members 29 are constructed so that the points 36 are initially closer together than the thickness of the pivot wall. They are resiliently spread slightly when the pivot wall is inserted, and so they retain the pivot wall by a gripping action. After the key member 20 has been pivoted a few times, a small indentation, as shown in FIG. 6, is formed on each side of the pivot wall, by the pivot points, and this indentation also helps to maintain the assembly in assembled condition.

A rib 78 extends below the bottom surface of the pivot wall 74, and the rib 78 is adapted to enter a notch 80 provided at a place directly below a pair of pivot points 36. The function of the rib 78 is to greatly rigidify the key assembly against twisting movement about an axis extending longitudinally of the key 20.

A pair of tabs 82 have their upper edges formed integrally with each of the side walls 46 and 48 and extend downwardly therefrom at positions which are spaced slightly outwardly from the walls 46 and 48 by a space 83. The tabs are relatively flexible, because of their thinness, and the fact that they are attached to their respective side walls 46 and 48 only at their upper edges. The tabs 82 engage the upper outside corners of the pivot members 29. The tabs 82 greatly reduce vibration of the key member during opertion of the instrument.

At their forward ends, the bottom edge 50 of each of the side walls 46 and 48 has a horizontal portion 85, which is adapted to engage a felt pad 84 fastened on the upper side of the support 14. Downward movement of the key member 20 is restrained when the edge 82 engages the resilient pad 84. The pad 84 is selected from material such as felt which will not produce any audible sound when struck by the edge 85.

The guide strip 18 is secured to the support 14 by means of screws or the like 86, and it comprises an elongate strip having integral upstanding stiffening walls, one of which has integral parallel horizontal portions projecting rearwardly in vertically aligned pairs. Each pair of projections includes an upper projection 88 and a lower projection 90, which are vertically aligned with one of the key members 20 and 21. Each of the projections 88 and 90 is T-shaped with an enlarged end portion 92 and a relatively narrow stem portion 94. The stem portion 94 of the upper projection 88 is formed with a vertical portion extending upwardly from the main body of the strip 18, joined with a horizontal portion extending rearwardly from the upper end of the vertical portion. A guide bushing 95 of resilient material, such as rubber, is positioned on the stem 94 of the upper projection 88 and retained in its position by the enlarged end 92. The material of which the guide bushing 95 is formed is sufficiently resilient so that it can be slipped over the enlarged portion 92 during assembly.

The inside surface of each of the side walls 46 and 48 is provided with a vertically raised guide surface 100, so that the two guide surfaces 100 can contact opposite sides of the resilient guide bushing 95. The resilient material 95 is received between the two opposed guide surfaces 100, and functions to guide the front portion of the key member 20 during upward and downward movement. The bushing 95 is sized so as to occupy the space between the guide surfaces 100 without touching either surface, unless lateral force is applied to the key, which force is then resisted by the bushing. The resilient material of the guide bushing 95 is preferably chosen to be of relatively hard consistency, so that it can perform its guiding function without and substantial compression. It is preferably lubricated or treated to resist friction.

A resilient bushing 102 is slipped onto the lower projection 90 past its enlarged end portion 92, which thereafter holds it in place. The lateral dimension of the bushing 102 is somewhat less than that of the bushing 95, so that it does not engage the ribs 100. The bushing 102 has a plurality of downwardly extended projections, which are adapted to engage the upper surface of the web 56 when the key 20 is in its upper position (as shown in FIG. 5). The bushing 102 is formed of material which is relatively soft so that it can engage the web 56 and stop upward movement of the key when the latter is released, without producing any audible sound.

The key members 20 and 21 are made of a plastic material which does not have any tendency to stick to the guide bumper material. In one embodiment, the key members are formed of an ABS plastic material such as material marketed by the Borg Warner Corporation as X-17.

To achieve optimum characteristics, different materials are preferred for the bushings 95 and 102. The function of the lower bushing 102 is to limit movement of the key members, without creating any noise and without any sticking. The preferred material for this function is silicone material which is commercially available from a number of sources.

The function of the upper bushing 95 is to guide vertical movement of the key members, while maintaining the key members in properly aligned position relative to each other. This function is best served by a material which is harder than silicone material. The bushings 95 are preferably formed of buna rubber, a material which is commercially available from a number of sources. This material is stiff enough to maintain the key members in properly oriented position, but soft enough to allow easy up and down movement without sticking. The anti-stick characteristic of the material can be improved further, if desired, by providing a teflon coating on the bushing.

The upper bushings 95 for the black keys are formed of the same material as the white keys, but with a composition which is slightly softer, compensating for the different mechanical characteristics of the black key members, as they are shorter in length.

It has been found that the provision of two separate materials for the upper and lower bushings 95 and 102 is an economical way of achieving optimum performance characteristics of the keyboard assembly, virtually completely eliminating problems of misalignment, sticking and noise associated with some previously known arrangements.

The guide strip 18, in providing pairs of vertically aligned projections 88 and 90, makes it possible to align accurately the forward ends of all of the key members of the keyboard, and to automatically align the bushings 102, without the need for any positioning or alignment process which must be carried out key-by-key.

At the rear end of the key member 20 an actuator wire 110 has one end firmly secured to the key member 20, and its other end terminates in a hook 112. A spring 114 having one end secured to the frame (not shown) of the assembly has its other end secured to a switch actuator member 116. The spring 114 biases the actuator wire 110 downwardly, which urges the key member 20 to move in its counterclockwise direction about its fulcrum until the web 56 engages the up-stop bushing 102. In this position of the actuator member 116, an associated switch (not shown) is unoperated. The switch is operated by downward movement of the forward portion of the key member 20, which raises the actuator wire 110 and the actuator member 116. A multiple pole switch may be used if desired, as well known in the art.

The actuator wire 110 is secured to the rear end of the key member 20 without the need for any separate fastening devices. The rear end of the key member 20 is constructed in such a way that the actuator wire 110 may be inserted manually and snapped into place by use of a simple tool, after which it is firmly held in its proper position.

Spaced somewhat to the rear of the pivot channel 16, the stiffening member 58 terminates in an end wall 120. Slightly forward of the end wall 120, an elongate rectangular aperture 122 is provided in the member 58, and immediately forward of the aperture 122 a recess 124 is provided in the upper surface of the member 58. The aperture 122 forms a window which allows the insertion of an end of the actuator wire 110, and a ledge formed by the bottom of the recess 124 supports the end of the actuator wire 110 when it is fully assembled, as illustrated in FIG. 3. The recess 124 ends at the wall 61. The rear surface of the wall 62 engages a part of the actuator wire 110, locating the actuator support wire in a longitudinal direction relative to the key member 20.

Spaced to the rear of the member 58 (FIGS. 3 and 4), a projection 126 extends inwardly from the inner surface of the wall 46, and a projection 128 extends inwardly from the inner surface of the wall 48 in alignment with the projection 126. The inner ends of the projections 126 and 128 are spaced apart a distance somewhat less than the diameter of the actuator wire 110, and are adapted to hold the actuator wire 110 in fixed position relative to the key, after the wire is installed. During assembly, a portion of the actuator wire 110 is passed between the projections 126 and 128, and the side walls 46 and 48 flex sufficiently to allow it to pass, after which the side walls spring back to regain their original positions.

To the rear of the projections 126 and 128, a wall 130 extends between the side walls 46 and 48, and the wall 130 has a V-notch 132 formed in its lower edge. The V-notch 132 is adapted to receive a horizontal part 131 of the actuator wire 110, so as to locate the horizontal part both in a vertical and in a horizontal direction, during and after assembly.

To the rear of the wall 130 and end wall 134 joins the rear ends of the side walls 46 and 48. The upper edge 136 of the end wall 134 is spaced below the apex of the notch 132 by a distance approximately equal to the diameter of the actuator wire 110, so that the horizontal portion 131 of the actuator wire 110 can extend generally horizontally while one end of this portion is supported on the surface 136 and the other end is in engagement with the notch 132.

A tab 138 extends inwardly from the end of the side wall 46 toward the side wall 48, but does not quite reach it, leaving a gap 140 which is about the same as the diameter of the actuator wire 110. During assembly a portion of the actuator wire is inserted into the gap 140 until it reaches the upper surface 136 of the end wall 134, after which it can move laterally away from the slot 140.

Figure 7:
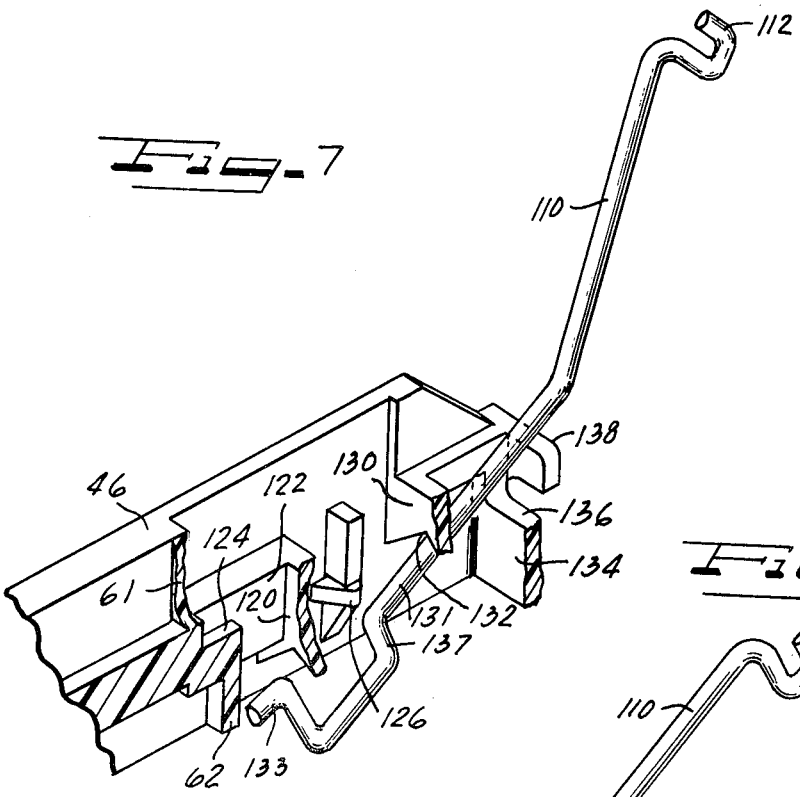
FIGS. 7-9 illustrate successive steps in the assembly of an actuator wire with a key member of the present invention.
Figure 8:
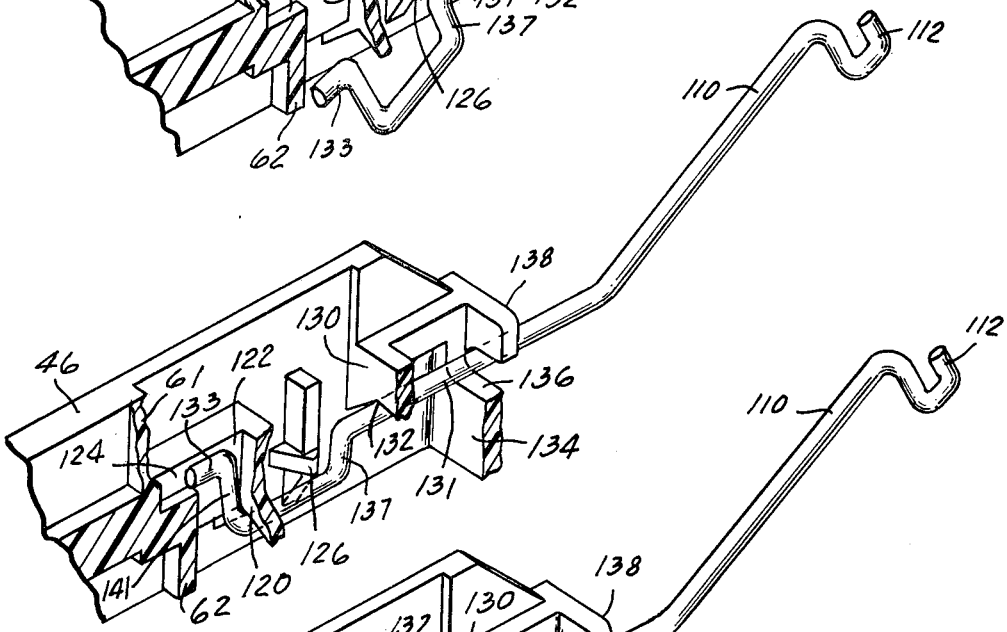
Figure 9:
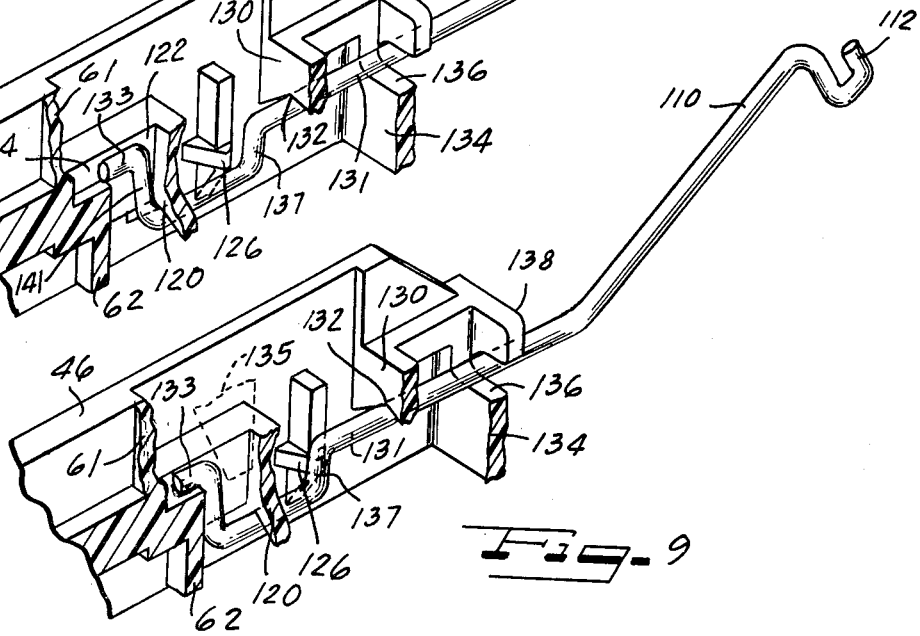

Referring now to FIGS. 7–9, the manner in which the actuator wire 110 may be assembled with the key member 20 is illustrated. The key member 20, and its actuator wire 110, comprise the only two parts needed to make an individual key. The first step is the insertion, as illustrated in FIG. 7, shows that the forward end 133 of the actuator wire 110 has been passed downwardly through the space between the end wall 134 and the wall 130. The next step is shown in FIG. 8, which shows that the actuator wire 110 has been rotated in a clockwise direction from the position illustrated in FIG. 7, until the shaped forward end 133 of the actuator wire 110 is passed upwardly through the aperture 122. In this connection, the forward end of the actuator wire is positioned within the aperture 122, and the central portion of the wire 110 is positioned by the notch 132 in the bottom edge of the wall 130. The relative positions of the notch 132 and the aperture 122 aligns the actuator wire 110, and the tab 138 overlies the rear end of the horizontal portion 131 of the wire 110, which has moved laterally on the surface 136 to a point below the tab 138, as a result of positioning the forward end of the wire 110 in the aperture 122.

The position of the wire as illustrated in FIG. 8 is one which can be maintained indefinitely without the need for any external force on the wire 110. The end 133 is advanced into recess 124 until wire section 137 reaches the projections 126 and 128 to maintain the wire in position. Completion of the insertion of the wire 110, to arrive at the position illustrated in FIG. 9, is effected by insertion of a wedge tool 135 into the space between the rear end of the aperture 122 and the wire 110, with the angle of surface of the wedge adjacent the wire. Lowering of the wedge drives the wire forwardly until a vertical portion 141 of the wire engages the wall 62, which locates it longitudinally relative to the key member 20. The forward motion of the wire causes a vertical portion 137 thereof to pass between the projections 126 and 128, springing the side walls 46 and 48 apart slightly, after which the resiliency of the side walls restores the projections 126 and 128 of their former position where they block outward movement of the wire 110 relative to the key member 20.

Because of the orientation of the wire 110 by the various apertures, projections and notches described above, the final orientation of the wire is precisely the same for each of the key members 20 and 21. This identity of configuration of the various keys of the keyboard minimize the necessity for any individual adjustment of the actuator wires 110, thus overcoming a major disadvantage of the construction of keyboards by previously known techniques, since individual adjustment of the actuator wires is not required. It is apparent that each key of the present invention is composed of only two components, viz., a key member and an actuator wire.

From the foregoing, it will be appreciated that an extremely simple keyboard assembly is provided formed of only a few parts, in which all of the keys of the keyboard are positively located longitudinally, laterally and rotationally. The keyboard is assembled simply by snapping the keys into their positions relative to the pivot channel 16, the actuator wires 110 having been previously assembled with each key member in such a way that no manual adjustment is required after assembly of the keyboard. The provision of the key guide strip 18, with its pairs of vertically aligned projections, aligns and guides the forward ends of the keys in their vertical movement, and provides a cushioned stop when an operated key is released. Because both projections are integral with a single strip, no alignment procedures are required.

It will be apparent that various additions and modifications may be made in the present invention without departing from the essential features of novelty thereof, which are intended to be defined and secured by the appended claims.

What is claimed is:

1. For use in a musical instrument having a keyboard with a plurality of keys, at least some of said keys each having a pair of side walls separated by an interior space, the combination comprising a fixed bracket having a plurality of first projections, a plurality of first resilient members each supported on one of said first projections within said interior space and adapted to guide said side walls in up and down movement, said bracket having a plurality of second projections vertically aligned with said first projections, and a plurality of second resilient members supported on said second projections for limiting the up and down movement of said keys in at least one direction, said first and second projections being integral with said bracket, said keys being each provided with a horizontal web integrally formed with said two side walls and connected therebetween below said second resilient member, whereby upward movement of said key is limited by engagement of said web by said second resilient member, said second resilient member having a plurality of downwardly extending projections for engaging said web and stopping upward movement of said key without producing any audible sound.

2. Apparatus according to claim 1, including a raised guide surface on each of said side walls for engaging said first resilient member.

3. Apparatus according to claim 1, wherein each said first resilient member is shaped as a hollow sleeve-like bushing encircling a first projection, said sleeve bearing against the interior surfaces of both of said side walls for guiding said key.

4. Apparatus according to claim 3, wherein each of said projections is T-shaped, with an enlarged end portion and a narrower stem portion, said bushing being retained on said stem portion by said enlarged end portion.

5. Apparatus according to claim 1, wherein some of said keys are shorter than others, said first resilient members for said shorter keys being softer than the first resilient members for the other keys.

6. A keyboard assembly according to claim 1, wherein said bracket is formed of one piece of sheet metal.

* * * * *